US007137835B2

(12) United States Patent
Shiga

(10) Patent No.: US 7,137,835 B2
(45) Date of Patent: Nov. 21, 2006

(54) LEVER TYPE CONNECTOR

(75) Inventor: Katsumi Shiga, Chiba (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 0 days.

(21) Appl. No.: 11/116,479

(22) Filed: Apr. 28, 2005

(65) Prior Publication Data

US 2005/0245114 A1 Nov. 3, 2005

(30) Foreign Application Priority Data

Apr. 28, 2004 (JP) ..... 2004-134569

(51) Int. Cl.
*H01R 13/62* (2006.01)

(52) U.S. Cl. ..... 439/157

(58) Field of Classification Search ..... 439/157, 439/372

See application file for complete search history.

(56) References Cited

U.S. PATENT DOCUMENTS 5,401,179 A * 3/1995 Shinchi et al. ..... 439/157
5,474,461 A * 12/1995 Saito et al. ..... 439/157
5,562,465 A * 10/1996 Taguchi et al. ..... 439/157
5,609,494 A * 3/1997 Yamaguchi et al. ..... 439/157
5,823,809 A * 10/1998 Wakata ..... 439/157
5,928,010 A * 7/1999 Katsuma et al. ..... 439/157
5,997,321 A * 12/1999 Nakata et al. ..... 439/157
6,174,179 B1 * 1/2001 Okabe ..... 439/157
6,319,050 B1 * 11/2001 Miyazaki et al. ..... 439/489
6,325,647 B1 12/2001 May et al.
6,325,648 B1 * 12/2001 Bilezikjian et al. ..... 439/157
6,602,082 B1 * 8/2003 Nishide et al. ..... 439/157
6,623,286 B1 * 9/2003 Tachi ..... 439/157
6,623,287 B1 * 9/2003 Hatagishi et al. ..... 439/157
6,733,312 B1 * 5/2004 Fujii ..... 439/157
6,739,888 B1 * 5/2004 Kato et al. ..... 439/157
6,764,324 B1 * 7/2004 Shinozaki et al. ..... 439/157
6,863,463 B1 * 3/2005 Matsushita ..... 403/322.4

FOREIGN PATENT DOCUMENTS

JP 09/120861 5/1997
JP 09-147973 6/1997
JP 2003-317865 11/2003

* cited by examiner

*Primary Examiner*—Gary Paumen
(74) *Attorney, Agent, or Firm*—Barley Snyder LLC

(57) ABSTRACT

A lever type connector on a housing and a lever thereof a locking mechanism that locks the lever in the final position. The locking mechanism has a housing-side locking arm that extends substantially along the pivoting track of the lever from the side of the initial position of the housing to the side of the final position and underneath this pivoting track, and a lever-side locking arm that is provided on the lever and that extends in the direction opposite from the direction of extension of the housing-side locking arm. The lever-side locking arm has a lock release on the upper side of the free end thereof, and also has a locking part that locks with the housing-side locking arm underneath the lock release.

11 Claims, 16 Drawing Sheets

LEVER TYPE CONNECTOR

FIELD OF THE INVENTION

The present invention relates to a lever type connector.

BACKGROUND

When the number of contacts in mutually mating connectors increases, the mating force is increased, so that the mating characteristics deteriorate. In order to prevent this deterioration in the mating characteristics, a lever type connector shown in FIGS. 16A and 16B, for example, has been developed in the past (see Japanese Patent Application Kokai No. H9-120861).

The lever type connector 101 shown in FIGS. 16A and 16B comprises a housing 110 that accommodates a plurality of contacts (not shown in the figure), and a lever 120 that is attached to the housing 110 so that this lever can pivot between the initial position and the final position.

Here, the housing 110 comprises a contact accommodating part 111 that accommodates a plurality of contacts and a hood part 112 that receives a mating connector 140. Supporting shafts 114 for supporting the lever 120 in a pivotable manner are provided on both side walls of the hood part 112 in the direction of width (direction perpendicular to the plane of the page in FIG. 16A). Furthermore, guide grooves 113 for drawing in cam followers 141 that are provided on both side surfaces of the mating connector 140 in the direction of width are formed in both side walls of the hood part in the direction of width.

Moreover, the lever 120 is formed with a substantially U shape so that this lever straddles the hood part 112 from above, and comprises a pair of arm parts 122 that are positioned on the outside of either side wall of the hood part 112 in the direction of width, and a base part 121 that connects the upper ends of these arm parts 122. The two arm parts 122 are shaft-supported by the supporting shafts 114 provided on the hood part 112. Furthermore, cam grooves 123 that engage with the cam followers 141 of the mating connector 140 are formed in the two arm parts 122.

In addition, the housing 110 and lever 120 are provided with a locking mechanism 130 that locks the lever 120 in the final position shown in FIG. 16A. The locking mechanism 130 is constructed from a housing-side locking part 133 that extends from the contact accommodating part 111 of the housing 110, and a lever-side locking part 131 that extends from the base part 121 of the lever 120 and that locks with the housing-side locking part 133 when the lever 120 is located in the final position. A locking hole 134 into which a locking part 132 of the lever-side locking part 131 locks is formed in the housing-side locking part 133. Furthermore, an operation part 135 is formed on the upper end of the housing-side locking part 133 so that this operation part 135 protrudes rearward (toward the right in FIG. 16A), and a protruding part 136 is formed underneath the locking hole 134 of the housing-side locking part 133 so that this protruding part 136 protrudes forward. An inclined surface 137 that contacts the lower-front end of the lever-side locking part 131 is formed on the protruding part 136.

When the mating connector 140 mates with the lever type connector 101, the lever 120 is first pivoted into the initial position (position in which the introduction openings of the cam grooves 123 overlap with the guide grooves 113 of the hood part 112), and the mating connector 140 is inserted into the hood part 112. Then, when the cam followers 141 of the mating connector 140 enter the interior of the cam grooves 123 of the arm parts 122, the lever 120 is pivoted in the direction of arrow A from the initial position to the final position shown in FIG. 16A. As a result, the mating connector 140 is drawn into the back of the hood part 112, so that the mating of the mating connector 140 and the lever type connector 101 is completed. In this case, the locking part 132 of the lever-side locking part 131 enters the interior of the locking hole 134 in the housing-side locking part 133, and is locked into this locking hole 134, so that the pivoting of the lever 120 toward the initial position is blocked.

When the mating of the mating connector 140 and lever type connector 101 is to be released, the operation part 135 of the housing-side locking part 133 is pressed down. Then, as a result of this downward pressing operation of the operation part 135, the housing-side locking part 133 tilts rearward, so that the locked state of the locking part 132 of the lever-side locking part 131 with the locking hole 134 in the housing-side locking part 133 is released as shown in FIG. 16B. At the same time, the inclined surface 137 of the protruding part 136 butts against the lower-front end corner portion of the lever-side locking part 131, thus pushing this lever-side locking part 131 upward. Then, the lever 120 is pivoted from the final position to the initial position in the direction of arrow B, which is the opposite direction from the direction of arrow A. As a result, the mating of the mating connector 140 and the lever type connector 101 is released.

Furthermore, the lever type connector shown in FIG. 17 (see Japanese Patent Application Kokai No. H9-147973), for example, has also been known as a conventional lever type connector.

The lever type connector 201 shown in FIG. 17 also comprises a housing 210 that accommodates a plurality of contacts (not shown in the figure) and that receives a mating connector 240, and a lever 220 that is shaft-supported on the housing 210 so that this lever can pivot between the initial position and the final position.

Here, the housing 210 comprises a contact accommodating part 211 that accommodates a plurality of contacts, and a hood part 212 that receives the mating connector 240; an annular sealing member 213 is attached to the periphery of this housing. The sealing member 213 extends from the interior of the hood part 212 toward the periphery of the contact accommodating part 211, and an attachment band 213*a* is formed on the periphery of the contact accommodating part 211. Furthermore, guide grooves 215 for drawing in cam followers 241 that are provided on both side surfaces of the mating connector 240 in the direction of width are formed in both side walls of the hood part 212 in the direction of width.

Moreover, the lever 220 is formed with a substantially U shape so that this lever straddles the hood part 212 from above, and comprises a pair of arm parts 222 that are positioned on the outside of either side wall of the hood part 212 in the direction of width, and a base part 221 that connects the upper ends of these arm parts 222. The two arm parts 222 are shaft-supported in a pivotable manner by supporting shafts 214 that are provided on the hood part 212. Furthermore, cam grooves 223 that engage with the cam followers 241 of the mating connector 240 are formed in the two arm parts 222.

Furthermore, the housing 210 and lever 220 are provided with a locking mechanism 230 that locks the lever 220 in the final position shown in FIG. 17. The locking mechanism 230 is constructed from a housing-side locking part 234 that extends from the contact accommodating part 211 of the housing 210, and a lever-side locking part 231 that extends from the base part 221 of the lever 220 and that locks with the housing-side locking part 234 when the lever 220 is located in the final position. A locking part 232 that locks with the housing-side locking part 234 is formed on the lever-side locking part 231 so that this locking part 232 protrudes rearward, and a butting part 233 is formed to protrude downward from the locking part 232. The lower end of this butting part 233 butts against the upper surface of the attachment band 213*a* in the final position, so that the attachment band 213*a* is compressed between this lower end and the contact accommodating part 211.

Furthermore, when the mating connector 240 mates with the lever type connector 201, the lever 220 is first pivoted into the initial position (position in which the introduction openings of the cam grooves 223 overlap with the guide grooves 215 of the hood part 212), and the mating connector 240 is inserted into the hood part 212. Then, when the cam followers 241 of the mating connector 240 enter the interior of the cam grooves 223 of the arm parts 222, the lever 220 is pivoted in the direction of arrow A from the initial position to the final position shown in FIG. 17. As a result, the mating connector 240 is drawn into the back of the hood part 212, so that the mating of the mating connector 240 and the lever type connector 201 is completed. In this case, the locking part 232 of the lever-side locking part 231 is locked with the housing-side locking part 234, so that the pivoting of the lever 220 toward the initial position is blocked. Furthermore, at a stage slightly before the locking part 232 locks with the housing-side locking part 234, the butting part 233 butts against the attachment band 213*a*, and compresses the attachment band 213*a* as the lever 220 is pivoted.

When the mating of the mating connector 240 and lever type connector 201 is to be released, the housing-side locking part 234 is pressed downward to the rear. Then, the housing-side locking part 234 tilts rearward, so that the locked state of the locking part 232 of the lever-side locking part 231 with the housing-side locking part 234 is released. As a result, the lever 220 is slightly pushed back via the butting part 233 by the repulsion force of the compressed attachment band 213*a*, and is placed in a floating state. Then, the lever 220 is pivoted from the final position to the initial position in the direction of arrow B, which is the opposite direction from the direction of arrow A. As a result, the mating of the mating connector 240 and the lever type connector 201 is released.

However, the following problems have been encountered in these conventional lever type connectors shown in FIGS. 16A and 16B, and 17:

Specifically, in both of the lever type connectors 101 and 201 shown in FIGS. 16A and 16B, and 17, when the respective mating of the mating connectors 140 and 240 with the lever type connectors 101 and 201 is to be released, it is necessary to perform the downward pressing operation of the housing-side locking parts 133 and 234 for the purpose of releasing the locked state of the levers 120 and 220 and the pivoting operation of the levers 120 and 220 from the final position to the initial position in a direction different from that of this downward pressing operation. Accordingly, it is impossible to continuously perform the lock releasing operation of the levers 120 and 220 and the pivoting operation of the levers 120 and 220. Thus, for example, the need for performing these two operations with separate hands arises, and the releasing operation of the respective mating of the mating connectors 140 and 240 with the lever type connectors 101 and 201 cannot be performed easily.

Furthermore, in the case of the lever type connector 201 shown in FIG. 17, it is necessary to extend the sealing member 213 from the interior of the hood part 212 toward the periphery of the contact accommodating part 211, which creates the following problems: namely, there are structural restrictions, and the manufacturing cost is correspondingly increased.

SUMMARY

Accordingly, the present invention was devised in light of the problems described above; it is an object of the present invention to provide a lever type connector having an inexpensive construction which makes it possible to continuously perform the lock releasing operation of the lever and the pivoting operation of the lever, and to easily operate the releasing of the mating with the mating connector.

In order to solve the problems described above, the lever type connector of Claim 1 is a lever type connector comprising a housing which accommodates a plurality of contacts, and a lever which is shaft-supported on this housing so that this lever can pivot between the initial position and the final position, and which has cam grooves that engage with cam followers provided for a mating connector, the housing and the lever being provided with a locking mechanism that locks this lever in the final position, wherein the locking mechanism comprises a housing-side locking arm that extends substantially along the pivoting track of the lever from the side of the initial position of the housing to the side of the final position and underneath this pivoting track, and a lever-side locking arm that is provided on the lever and that extends in the direction opposite from the direction of extension of the housing-side locking arm, and this lever-side locking arm has a lock release on the upper side of the free end thereof, and also has a locking part that locks with the housing-side locking arm underneath the lock release.

DETAILED DESCRIPTION OF THE EMBODIMENTS

Next, an embodiment of the present invention will be described with reference to the figures.

Figure 10:
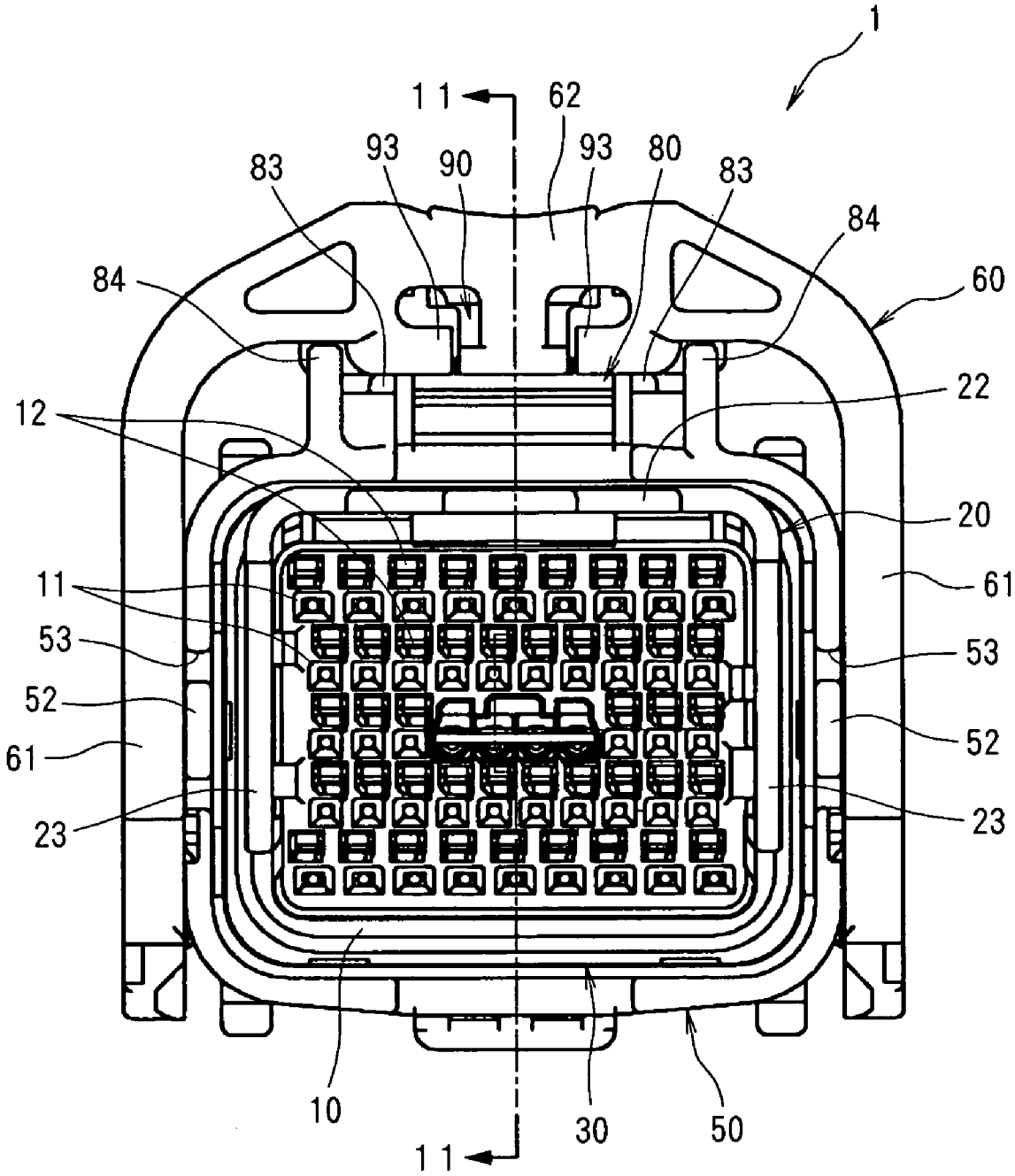
FIG. 10 is a front view of the lever type connector of FIG. 1 with the lever in the final position.
Figure 11:
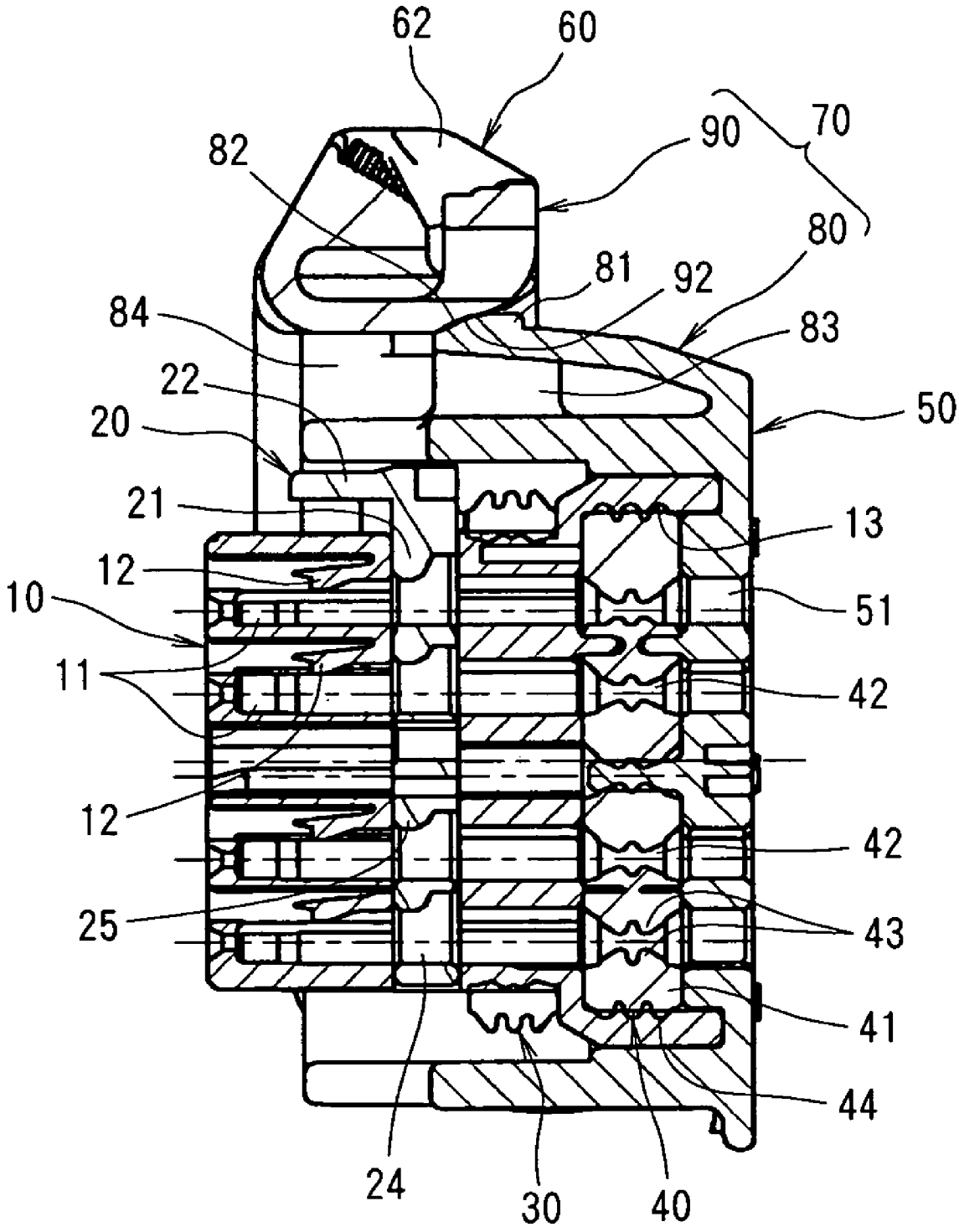
FIG. 11 is a sectional view along line 11—11 in FIG. 10.
Figure 12:
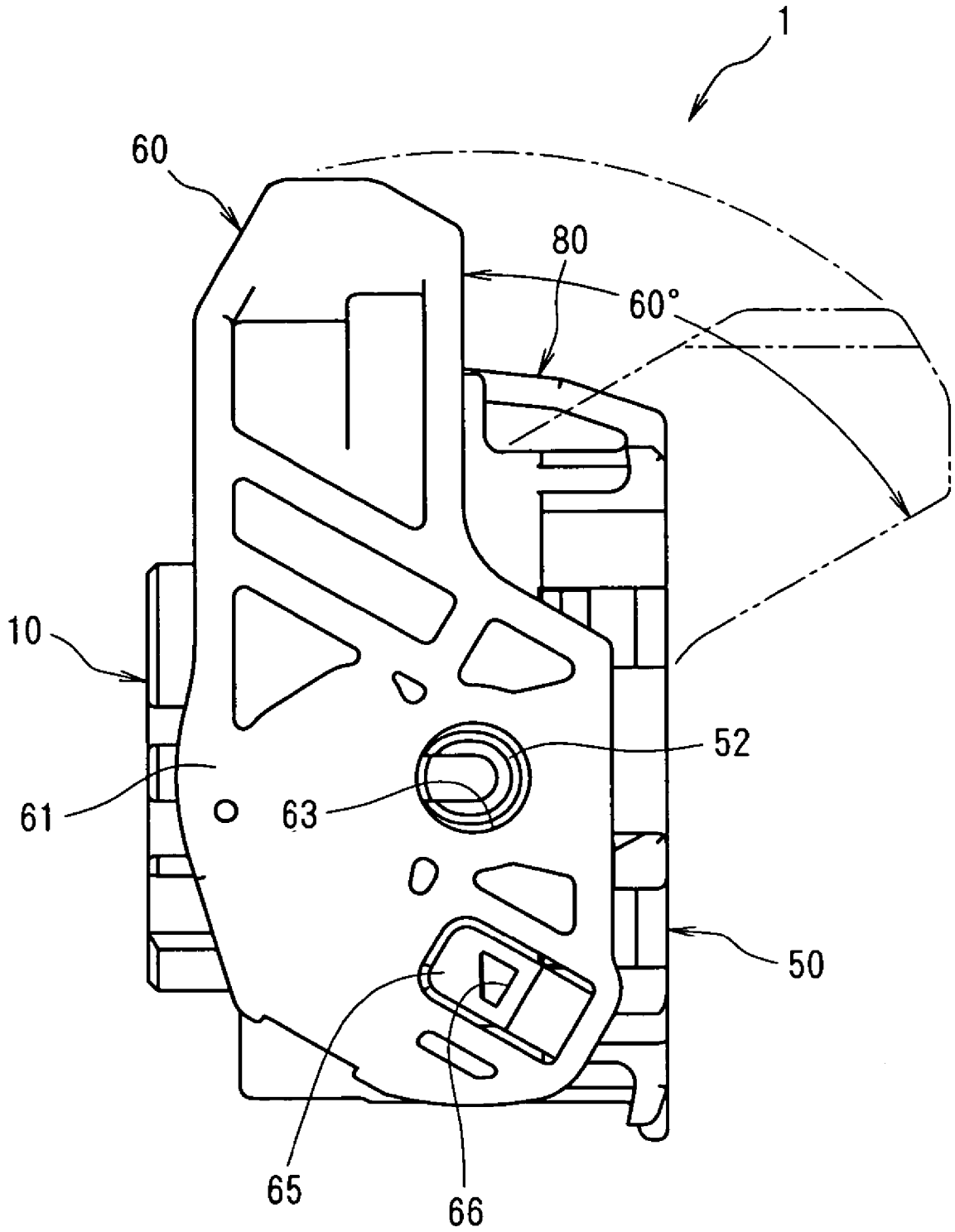
FIG. 12 is a right-side view of FIG. 10.

In FIGS. 1 through 12, a lever type connector 1 comprises a first housing 10 that accommodates a plurality of contacts (not shown in the figures), a retainer 20, a mating part sealing member 30, an electrical wire sealing member 40 (shown in FIG. 11), a second housing 50, and a lever 60 that is shaft-supported on the second housing 50 in a pivotable manner between the initial position shown in FIGS. 1 through 4 and the final position shown in FIGS. 6 through 12. The first housing and second housing constitute the "housing" described in the Claims. As is shown in FIG. 12, the lever 60 pivots approximately 60° on an actual device.

Here, the first housing 10 is formed with a substantially rectangular shape by molding an insulating resin, and has a plurality of rows of contact accommodating cavities 11 that accommodate the contacts. The individual contact accommodating cavities 11 are provided with housing lances 12 that perform primary locking of the contacts (not shown in the figures) that are inserted into the respective contact accommodating cavities 11. Moreover, a recessed part 13 (on the right side in FIG. 11) is formed on the side of the rear surface of the first housing 10 to seal electrical wiring.

The retainer 20 is used to perform secondary locking of the contacts that are accommodated inside the respective contact accommodating cavities 11, and comprises a rectangular base plate part 21, an upper plate part 22 that extends forward (to the left in FIG. 11) from the upper end of the base plate part 21, and a pair of side plate parts 23 that extend downward from either end of the upper plate part 22 in the direction of width. The retainer 20 is formed by molding an insulating resin. Furthermore, the retainer 20 is attached to the first housing 10 substantially in the central portion of this first housing 10 in the forward-rearward direction by the upper plate part 22 being positioned above the first housing 10 and the side plate parts 23 being positioned on the outside of the side portions of the first housing so that this retainer can move upward and downward between a temporary locking position and a main locking position. A plurality of rows of openings 24 for the insertion of the contacts that are to be accommodated into the respective contact accommodating cavities 11 are formed in the base plate part 21 of the retainer 20 in positions corresponding to the respective contact accommodating cavities 11. Furthermore, a secondary locking part 25 for performing the secondary locking of the corresponding contact is provided on the upper side of each opening 24. In the temporary locking position, as is shown in FIGS. 10 and 11, the retainer 20 is positioned above the upper surface of the first housing 10, with the upper plate part 22 having a specified gap, so that the contacts can be accommodated into the contact accommodating cavities 11 by passing through the openings 24. Moreover, in the main-locking position, the retainer 20 is devised so that the upper plate part 22 contacts the upper surface of the first housing 10, and so that the secondary locking of the contacts that are accommodated inside the contact accommodating cavities 11 is accomplished by the secondary locking parts 25.

In addition, the mating part sealing member 30 is used to form a seal between the mating part of a mating connector (not shown in the figures) and the first housing 10; this mating part sealing member 30 is formed with a substantially square ring shape, and is attached to the periphery of the first housing 10 toward the rear of the retainer 20.

The electrical wire sealing member 40 is disposed inside the electrical wire sealing member accommodating recessed part 13 of the first housing 10. The electrical wire sealing member 40 is constructed from a rubber material, and a plurality of electrical wire insertion holes 42 that extend between the two main surfaces of a substantially flat rectangular sealing main body 41 are formed in this sealing main body 41. The positions in which the electrical wire insertion holes 42 are formed correspond to the positions of the contact accommodating cavities 11. A plurality of projecting ribs 43 are provided on the inner wall surface of each of the electrical wire insertion holes 42. Furthermore, the projecting ribs 43 of respectively adjacent electrical wire insertion holes 42 are provided in different positions with respect to each other along the axial direction of the electrical wire insertion holes 42. When the contacts are accommodated inside the contact accommodating cavities 11, the plurality of electrical wires (not shown in the figures) that are connected to the contacts are positioned inside the electrical wire insertion holes 42 of the electrical wire sealing member 40, and the projecting ribs 43 provided for the electrical wire insertion holes 42 press the electrical wires from the peripheries of the electrical wires, thus sealing the electrical wires. As a result, the contacts inside the contact accommodating cavities 11 can be waterproofed from the outside. Furthermore, a plurality of projecting ribs 44 are formed on the outer circumferential surface of the sealing main body 41 of the electrical wire sealing member 40. As a result of the plurality of projecting ribs 44 contacting and pressing against the inner circumferential surface of the electrical wire sealing member accommodating recessed part 13, a seal is created between the outer circumferential surface of the sealing main body 41 and the inner circumferential surface of the electrical wire sealing member accommodating recessed part 13.

Furthermore, the second housing 50 is used to hold the electrical wire sealing member 40 that is disposed inside the electrical wire sealing member accommodating recessed part 13 of the first housing 10 from the side of the contact insertion surface (from the side of the rear surface), and is formed with a cap shape that covers the first housing 10, retainer 20, mating part sealing member 30, and electrical wire sealing member 40. Contact insertion holes 51 are formed in the second housing 50 in positions corresponding to the contact accommodating cavities 11 in the first housing 10 and the electrical wire insertion holes 42 in the electrical wire sealing member 40. Furthermore, supporting shafts 52 are provided on both side walls of the second housing 50 in the direction of width (left-right direction in FIG. 10) for the purpose of supporting the lever 60 in a pivotable manner. Moreover, as is shown in FIGS. 4, 9, 10 and 14, guide grooves 53 for drawing in cam followers C that are provided on both side surfaces of the mating connector in the direction of width are formed in the second housing 50. Furthermore, as is shown FIGS. 3, 4 and 14, locking projections 54 for locking the lever 60 in the initial position are formed toward the front of the second housing 50 so that these locking projections 54 protrude from both side walls of the second housing 50 in the direction of width. In addition, as is shown in FIGS. 3, 4, 8 and 9, stoppers 55 for preventing the lever 60 located in the initial position from excessively pivoting (i.e., excessively pivoting in the direction opposite from the direction of arrow A in FIG. 3) and for preventing the lever 60 located in the final position from excessively pivoting (i.e., excessively pivoting in the direction opposite from the direction of arrow B in FIG. 8) are formed on the rear ends of the second housing 50 so that these stoppers 55 protrude from both side walls of the second housing 50 in the direction of width. The second housing 50 is formed by molding an insulating resin.

Figure 1:
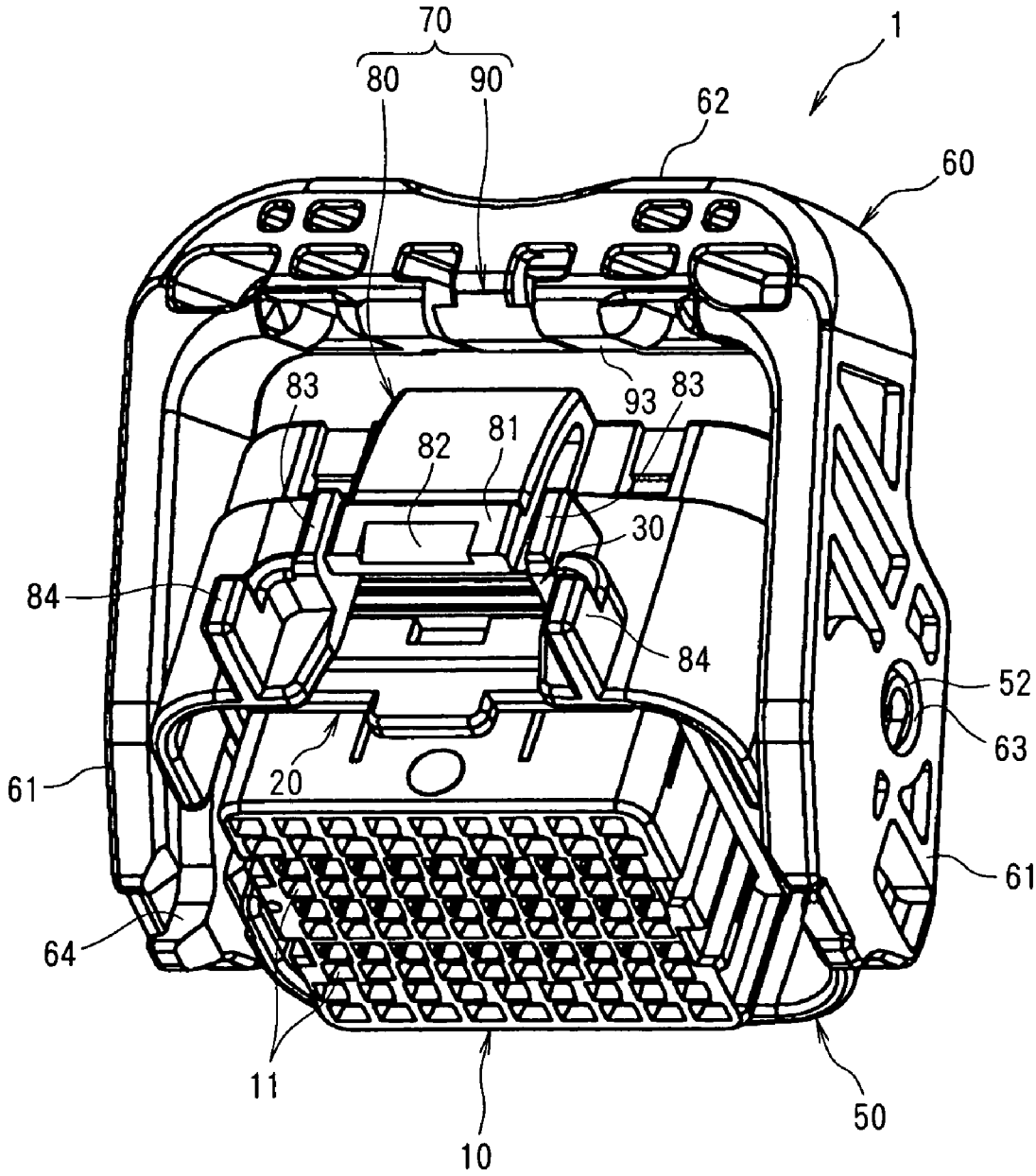
FIG. 1 is a perspective view of a lever type connector according to an exemplary embodiment of the present invention as seen from the front at an inclination from above, with this lever type connector being in a state in which the lever is in the initial position.
Figure 2:
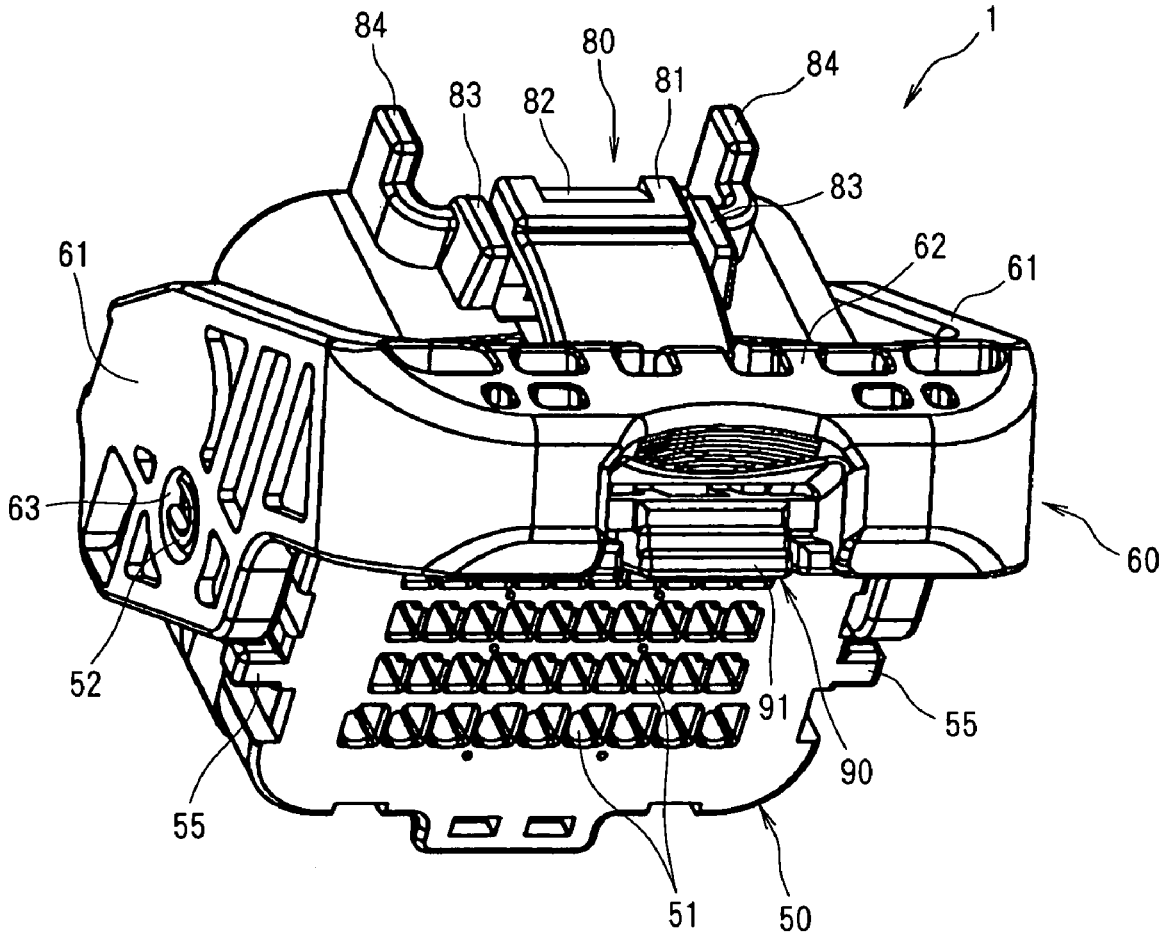
FIG. 2 is a perspective view of the lever type connector of FIG. 1 as seen from the back at an inclination from above.
Figure 3:
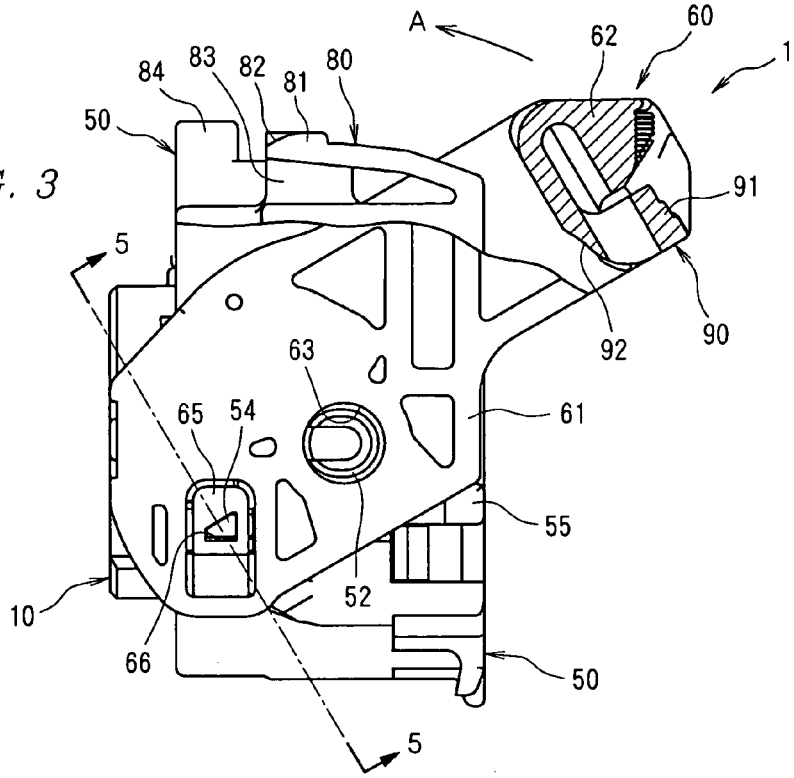
FIG. 3 is a side view partially in section of the lever type connector of FIG. 1 obtained by partially cutting the center of the lever type connector (in the direction of width), shown with the lever is in the initial position.
Figure 4:
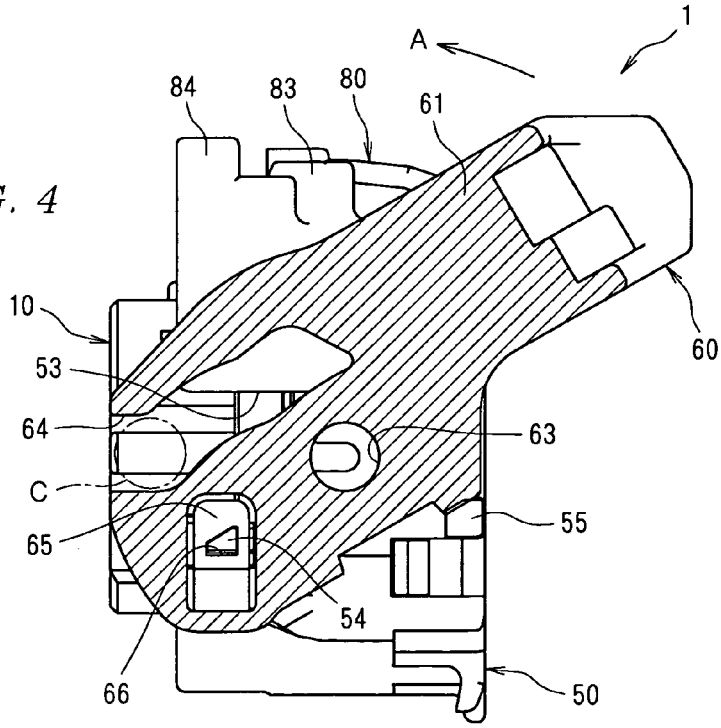
FIG. 4 is a side view partially in section of the lever type connector of FIG. 1 obtained by cutting the end portion of the lever type connector (in the direction of width) shown with the lever is in the initial position.
Figure 5:
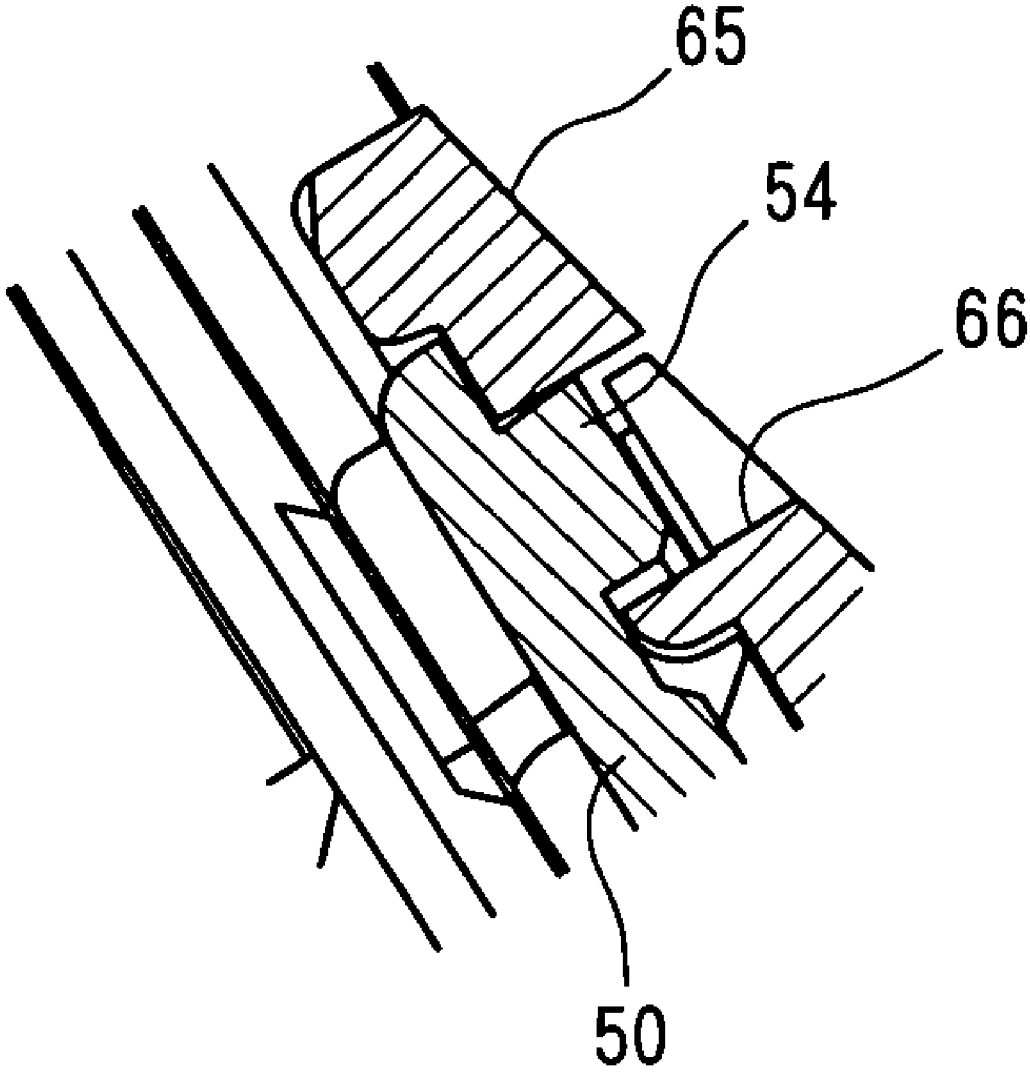
FIG. 5 is a sectional view along line 5—5 in FIG. 3.
Figure 6:
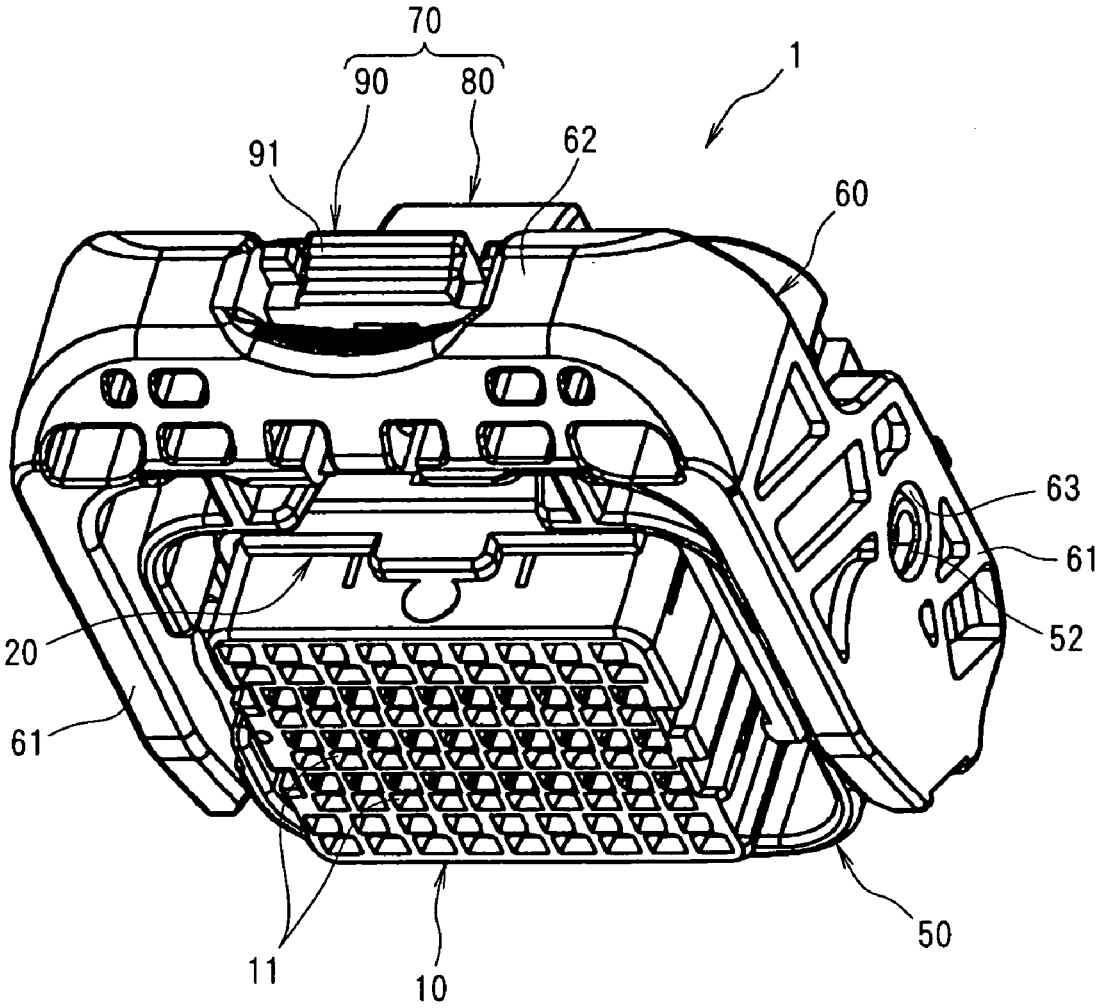
FIG. 6 is a perspective view of the lever type connector of FIG. 1 as seen from the front at an inclination from above, with the lever in the final position.
Figure 9:
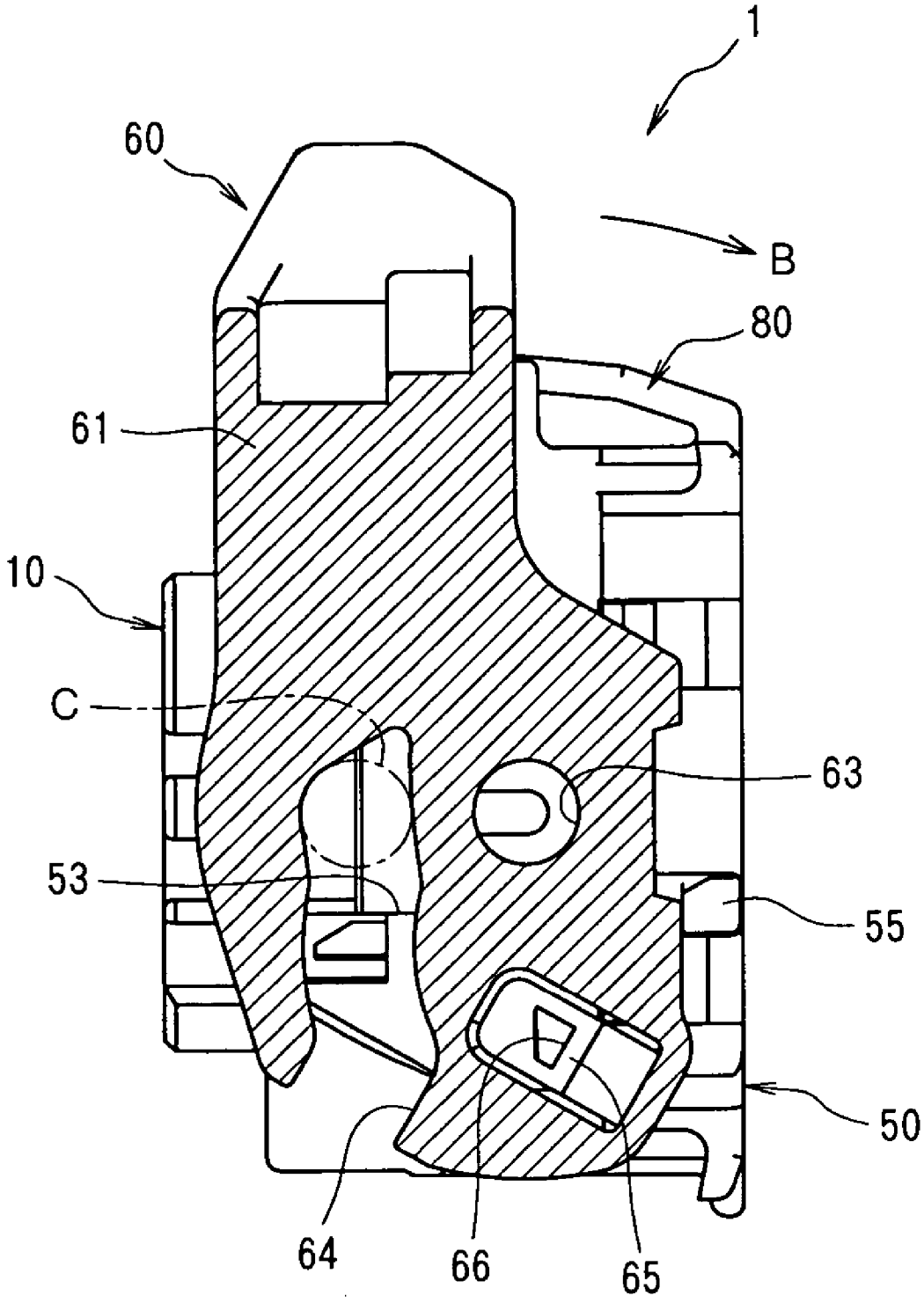
FIG. 9 is a side view partially in section of the lever type connector of FIG. 1 with the lever in the final position obtained by cutting the end portion of the lever type connector (in the direction of width)

Furthermore, the lever 60 is formed with a substantially U shape so that this lever straddles the second housing 50 from above, and comprises a pair of arm parts 61 that are positioned on the outside of either side wall of the second housing 50 in the direction of width, and a base part 62 that connects the upper ends of these arm parts 61. The lever 60 is formed by molding an insulating resin. Shaft holes 63 that are supported in a pivotable manner by the supporting shafts 52 provided on the second housing 50 are formed in both arm parts 61. Moreover, cam grooves 64 that engage with the cam followers C of the mating connector are formed in both arm parts 61. As is shown in FIG. 9, when the lever 60 is in the final position, the respective cam grooves 64 open downward in the arm parts 61. Furthermore, as is shown in FIGS. 3, 4, 5, 8, 9, and 15A through 15C, latch arms 65 that have locking holes 66 and that can be displaced in the inward-outward direction are provided in the vicinity of the cam grooves 64 of the two arm parts 61. As is shown in FIGS. 3 through 5, the locking projections 54 of the second housing 50 are engaged with the locking holes 66 in the latch arms 65; as a result, the lever 60 is locked in the initial position shown in FIGS. 1 through 4. In this case, the lever 60 that is in the initial position is prevented from excessively pivoting in the direction opposite from the direction of arrow A shown in FIGS. 3 and 4 by the arm parts 61 of the lever 60 contacting the stoppers 55.

Moreover, the second housing 50 and lever 60 are provided with a locking mechanism 70 that locks the lever 60 in the final position shown in FIGS. 6 through 12. The locking mechanism 70 is constructed from a housing-side locking arm 80 that extends from the second housing 50 and a lever-side locking arm 90 that extends from the lever 60.

The housing-side locking arm 80 has a cantilever structure that extends substantially along the pivoting track of the base part 62 of the lever 60 from the end of the upper wall of the second housing 50 on the side of the initial position (i.e., extends from the rear end) toward the final position (i.e., toward the front) underneath this pivoting track. A locking projection 81 that protrudes upward is formed on the free end of the housing-side locking arm 80. As is shown most clearly in FIGS. 13A and 13B, a ramp 82 that is tapered downward is formed on the upper surface of the tip end of this locking projection 81. Furthermore, a pair of housing-side locking arm protecting parts 83 that are positioned on either side of the housing-side locking arm 80 in the vicinity of the free end thereof and that protect this housing-side locking arm 80 are formed to protrude from the upper wall of the second housing 50. These housing-side locking arm protecting parts 83 make it possible to protect the housing-side locking arm 80; for example, it is possible to prevent an electrical wire from being entwined around the housing-side locking arm 80. Moreover, as is shown in FIGS. 10, 11 and 14, a pair of supporting parts 84 that restrict the downward movement of the base part 62 of the lever 60 when the lever 60 is locked in the final position are provided on the front end of the upper wall of the second housing 50. These supporting parts 84 make it possible to restrict the downward movement of the base part 62 of the lever 60 when the lever 60 is locked in the final position, and to prevent the application of excessive stress to the lever 60.

Meanwhile, the lever-side locking arm 90 has a cantilever structure that is being bent back from the lower portion of the front end of the base part 62 of the lever 60 and extends in the direction opposite from the direction of extension of the housing-side locking arm 80 (i.e., extends in the rearward direction). Furthermore, the lever-side locking arm 90 has a lock release 91 on the upper side of the free end thereof, and also has a locking part 92 that locks with the ramp 82 of the housing-side locking arm 80 underneath the lock release 91.

Figure 7:
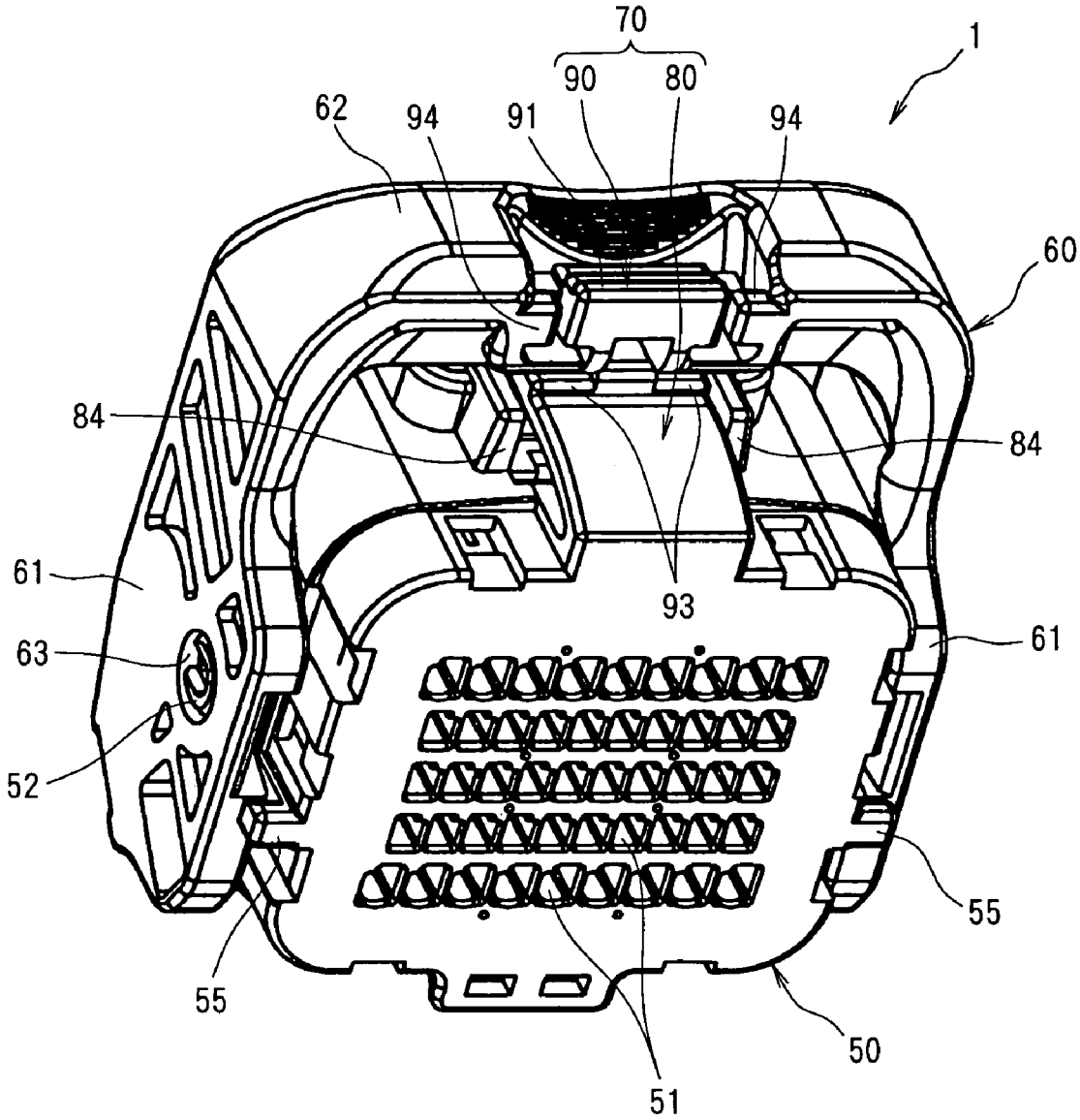
FIG. 7 is a perspective view of the lever type connector of FIG. 1 as seen from the back at an inclination from above with the lever in the final position.
Figure 8:
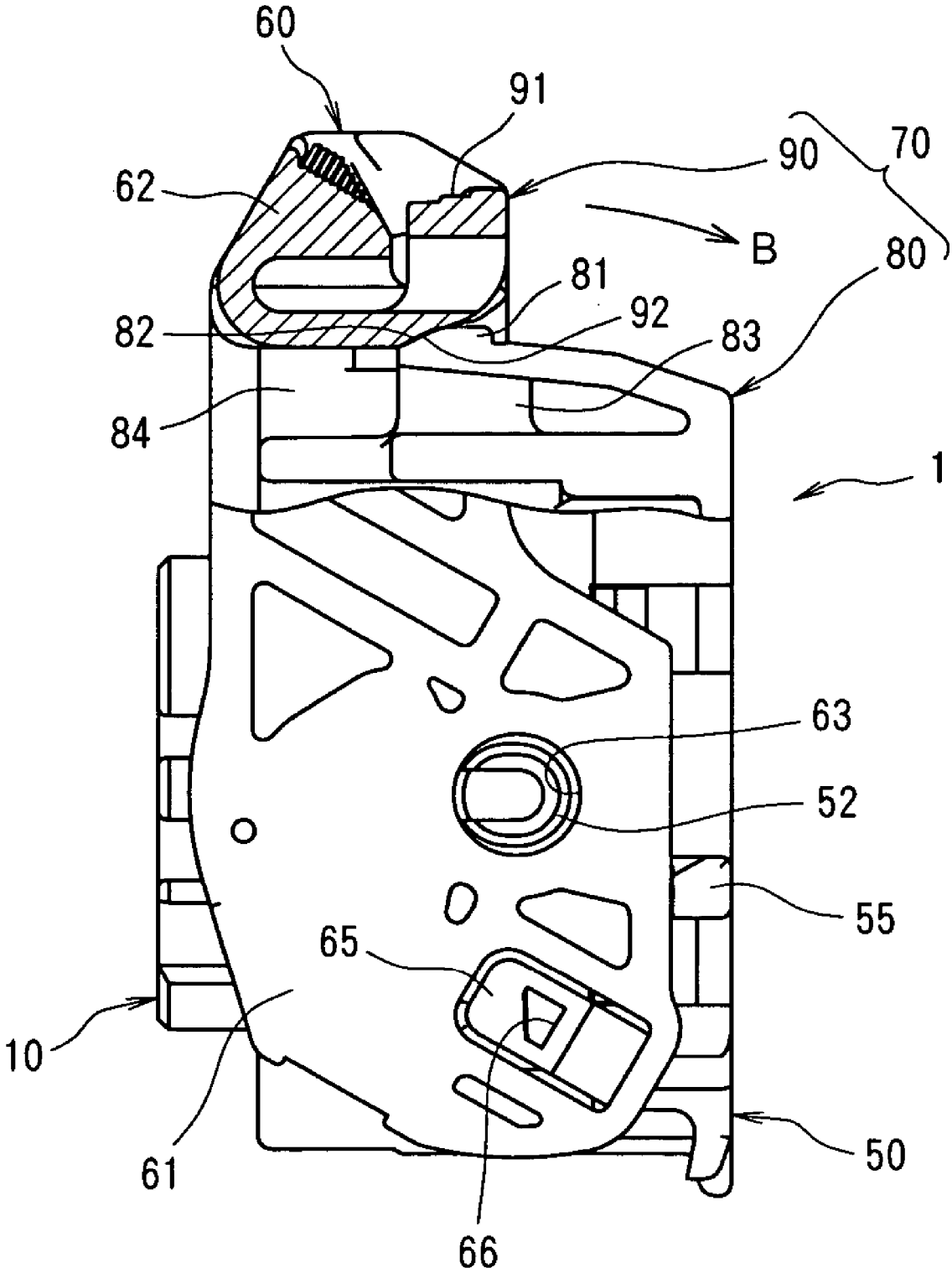
FIG. 8 is a side view partially in section of the lever type connector of FIG. 1 with the lever in the final position obtained by partially cutting the center of the lever type connector (in the direction of width)

As is shown clearly in FIG. 7, a pair of first lever-side locking arm protecting parts 93 and a pair of second lever-side locking arm protecting parts 94 that are positioned on either side of the lever-side locking arm 90 and that protect this lever-side locking arm 90 are formed on the base part 62 of the lever 60. The first lever-side locking arm protecting parts 93 are positioned on both sides of the flexible part of the lever-side locking arm 90 and protect this flexible part. The second lever-side locking arm protecting parts 94 are positioned above the first lever-side locking arm protecting parts 93 on both sides of the lock release 91, and protect this lock release 91. The lever-side locking arm 90 can be protected by these first lever-side locking arm protecting parts 93 and second lever-side locking arm protecting parts 94; for example, it is possible to prevent an electrical wire from being entwined around the lever-side locking arm 90.

When the mating connector mates with the lever type connector 1, the lever 60 is first pivoted into the initial position shown in FIGS. 1 through 4, and the mating connector is aligned with the first housing 10. In this case, the locking projections 54 of the second housing 50 are locked into the locking holes 66 of the latch arms 65 of the lever 60, thus locking the lever 60 in the initial position. Furthermore, when the cam followers C of the mating connector enter the interior of the cam grooves 64 in the arm parts 61 as shown in FIG. 4, and cam parts (not shown in the figures) in the vicinity of the cam followers C engage with the latch arms 65 of the lever 60, the latch arms 65 flex outward, so that the locking by means of the locking projections 54 of the second housing 50 with the locking holes 66 is released.

Next, the lever 60 is pivoted in the direction of arrow A from the initial position to the final position shown in FIGS. 6 through 12. Since this pivoting of the lever 60 in the direction of arrow A causes the cam followers C of the mating connector to be drawn in toward the rear along the cam grooves 64 as shown in FIG. 9, the mating connector is drawn into the back of the first housing 10, thus completing the mating of the mating connector and the lever type connector 1. As a result, contacts (not shown in the figures) provided for the mating connector and the contacts accommodated in the first housing 10 are electrically connected. In this case, as is clearly shown in FIGS. 8 and 13A, the locking part 92 of the lever-side locking arm 90 is locked with the ramp 82 of the housing-side locking arm 80, so that the pivoting of the lever 60 toward the initial position is blocked. In this locked state, the lever-side locking arm 90 and the housing-side locking arm 80 are mutually flexed slightly. Furthermore, the lever 60 that is in the final position is prevented from excessive pivoting in the direction opposite from the direction of arrow B shown in FIGS. 8 and 9 by the arm parts 61 of the lever 60 contacting the stoppers 55.

Figure 13A:
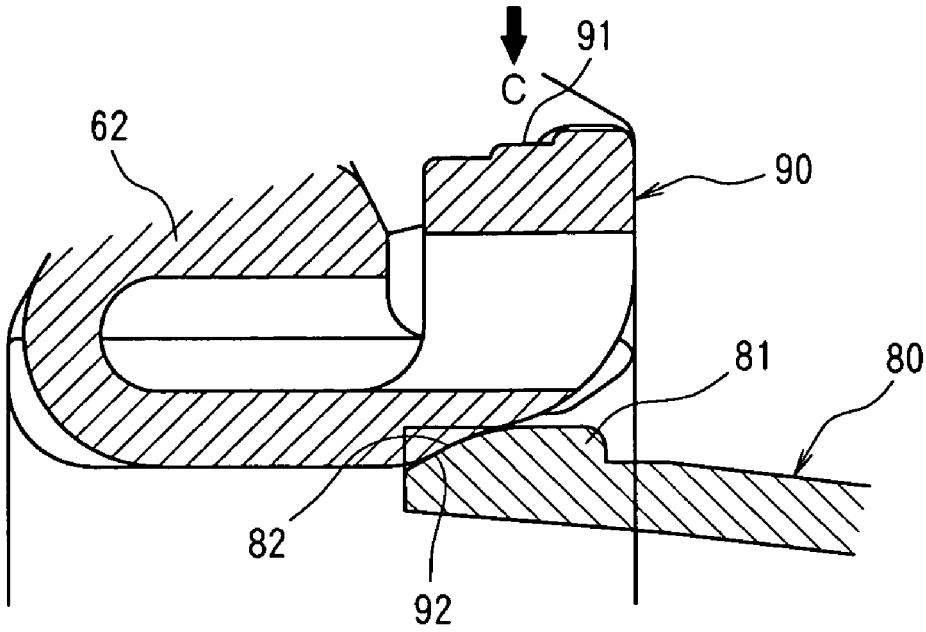
FIGS. 13A and 13B are detailed sectional views showing a locking mechanism of a lever type connector according to an exemplary embodiment of the present invention with FIG. 13A being an enlarged sectional view showing a state in which the lever-side locking arm is locked with the housing-side locking arm, and FIG. 13B being an enlarged sectional view showing a state in which the locking of the lever-side locking arm with the housing-side locking arm is released.
Figure 13B:
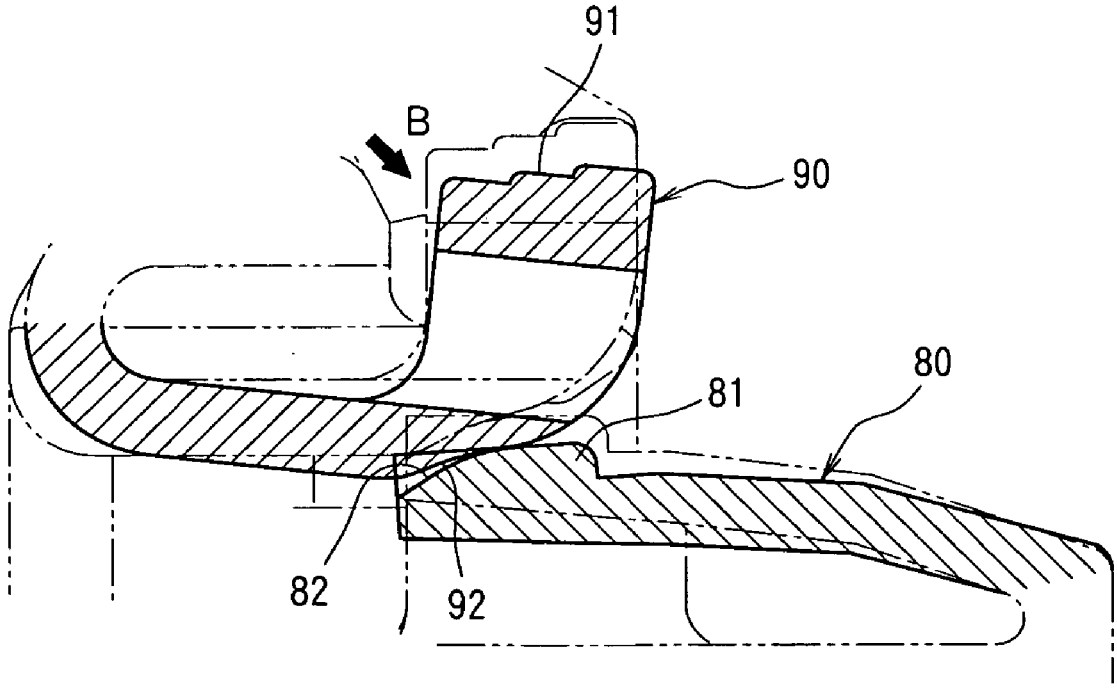
Figure 14:
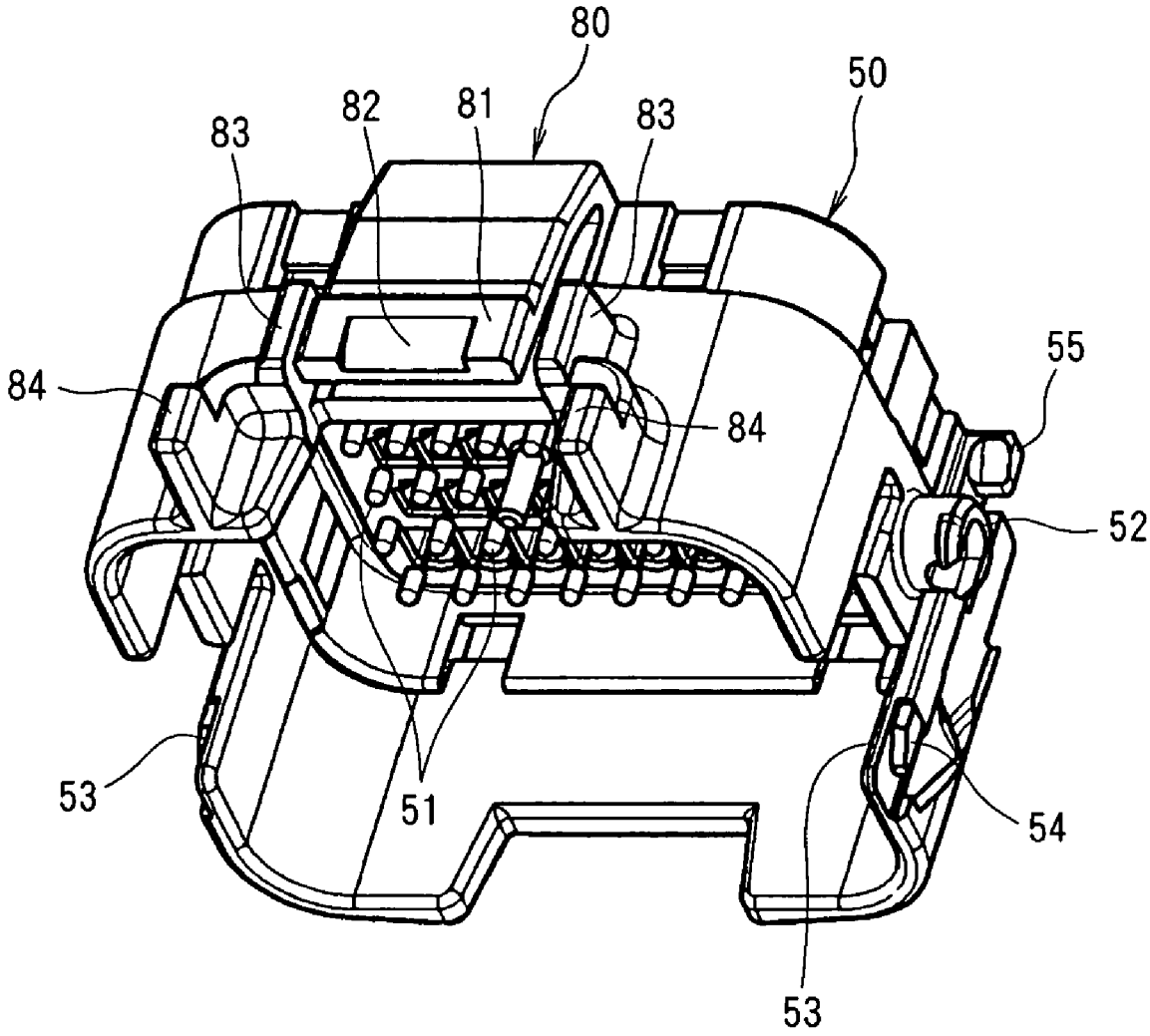
FIG. 14 is a perspective view of a second housing of a lever type connector according to an exemplary embodiment of the present invention as seen from the front at an inclination from above.
Figure 15B:
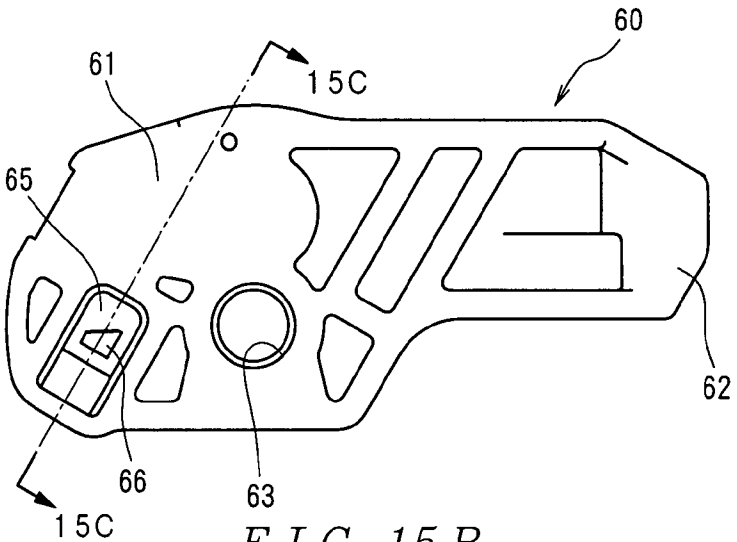
FIGS. 15A through 15C show the lever of a lever type connector according to an exemplary embodiment of the present invention, with FIG. 15A being a perspective view of the lever, FIG. 15B being a side view of the lever, and FIG. 15C being a sectional view along line 15C—15C in FIG. 15B.
Figure 15C:
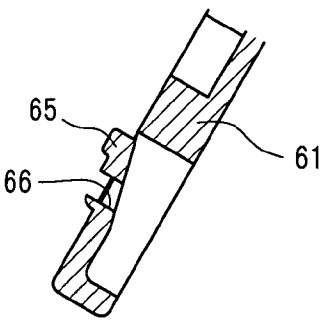
Figure 15A:
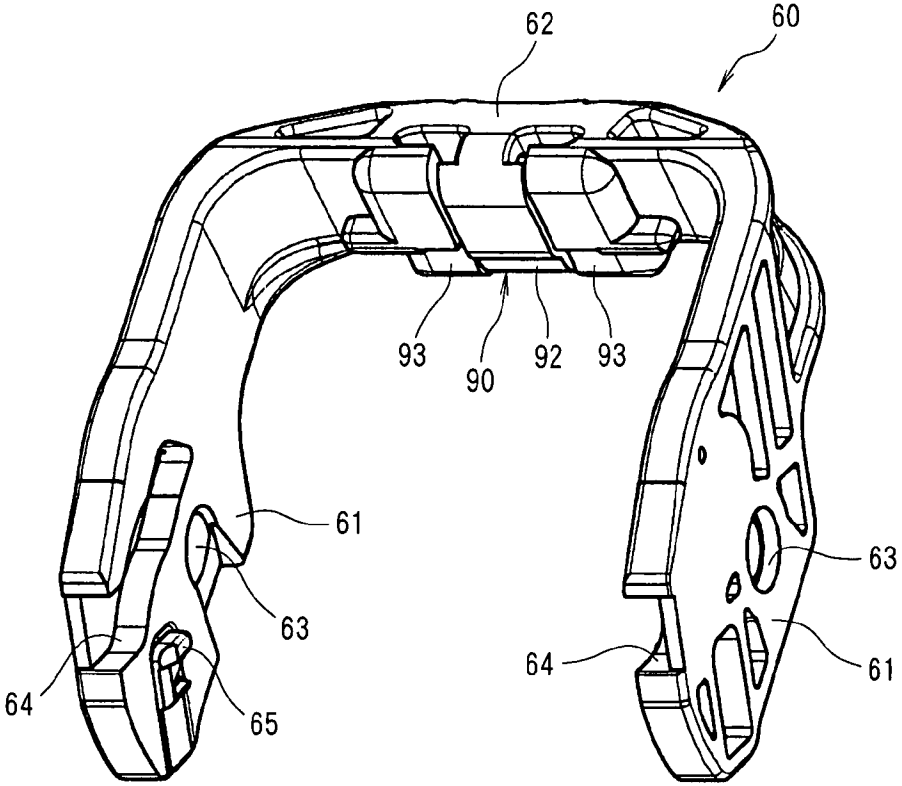
Figure 16A:
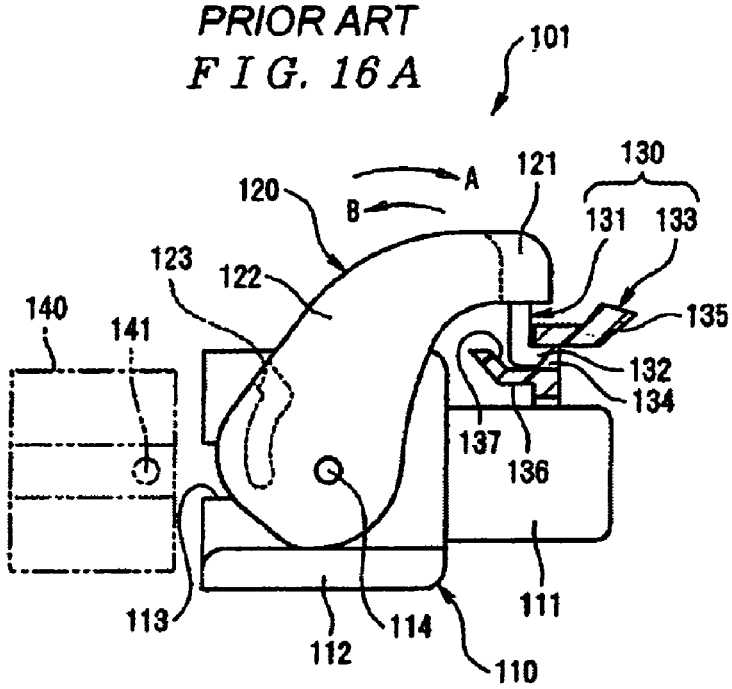
PRIOR ART FIG. 16A
FIGS. 16A and 16B are explanatory diagrams of a conventional example of a lever type connector.
Figure 16B:
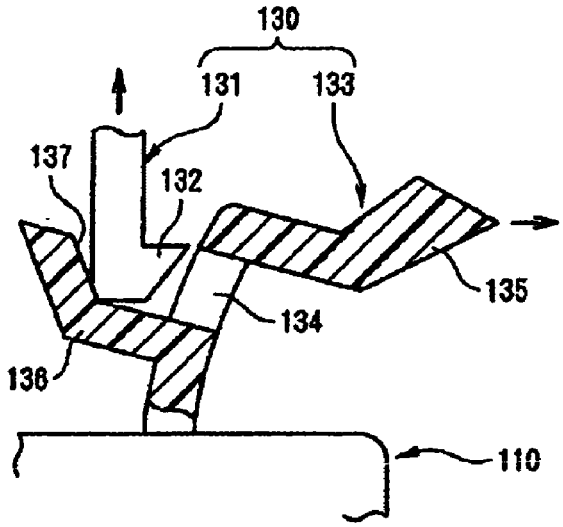
PRIOR ART FIG. 16B
Figure 17:
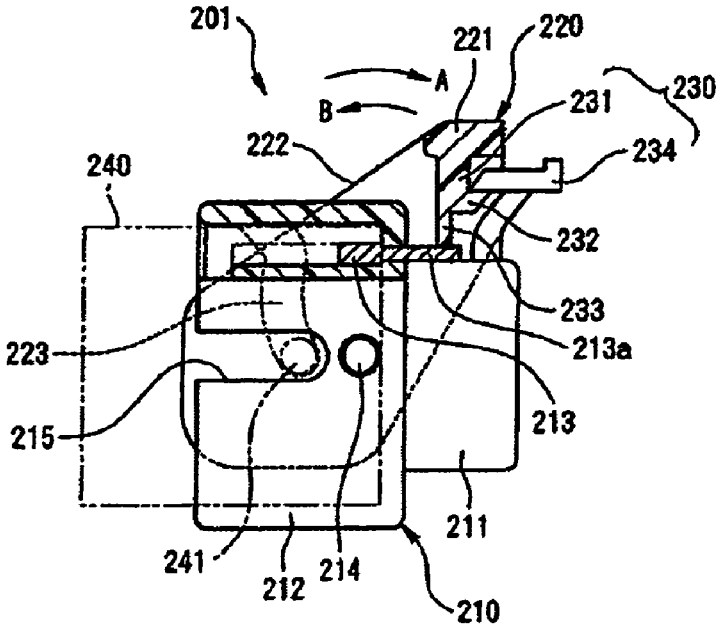
PRIOR ART FIG. 17
FIG. 17 is an explanatory diagram of another conventional example of a lever type connector.

Furthermore, when the mating of the mating connector and the lever type connector 1 is to be released, the lock release 91 of the lever-side locking arm 90 is pressed down in the direction of arrow C shown in FIG. 13A. Then, as a result of this downward pressing operation of the lock release 91, the locking part 92 of the lever-side locking arm 90 pivots downward substantially about the fixed end as shown in FIG. 13B, while the ramp 82 of the housing-side locking arm 80 pivots downward substantially about the fixed end of the housing-side locking arm 80 by being pressed by the locking part 92, so that the locked state of the locking part 92 of the lever-side locking arm 90 with the ramp 82 is released. Moreover, the lever 60 is pivoted from the final position to the initial position in the direction of arrow B shown in FIGS. 13B, 8 and 9, which is extremely similar to the direction of downward pressing (direction of arrow C) of the lock release 91. Then, since the cam followers C of the mating connector are taken out toward the front along the cam grooves 64 as shown in FIG. 4, it is possible to release the mating of the mating connector and the lever type connector 1. As a result, the electrical connection between the contacts (not shown in the figures) provided for the mating connector and the contacts accommodated in the first housing 10 is released.

Thus, in the present embodiment, the direction of downward pressing (direction of arrow C) of the lock release 91 of the lever-side locking arm 90 and the direction of pivoting (direction of arrow B) from the final position to the initial position of the lever 60 whose lock has been released are extremely similar. Accordingly, it is possible to perform the lock releasing operation of the lever 60 and the pivoting operation of the lever 60 in a continuous manner, so that it is possible to easily operate the releasing of the mating of the mating connector 60 and the lever type connector 1.

An embodiment of the present invention was described above. However, the present invention is not limited to this embodiment, and various alterations or modifications can be made.

For example, in a case where the electrical wire sealing member 40 is not used, it is not absolutely necessary to form the second housing 50. In this case, the lever 60 can be shaft-supported in a pivotable manner on the first housing 10, and a locking mechanism 70 that locks the lever in the final position can be installed on the first housing 10 and lever 60.

Furthermore, it is not absolutely necessary to form the housing-side locking arm protecting parts 83, supporting parts 84, first lever-side locking arm protecting parts 93, and second lever-side locking arm protecting parts 94.

What is claimed is:

1. A lever type connector comprising a housing which accommodates a plurality of contacts, and a lever which is shaft-supported on the housing so that the lever can pivot between an initial position and a final position, the lever having cam grooves that engage with cam followers provided on a mating connector, the housing and the lever being provided with a locking mechanism that locks the lever in the final position, wherein the locking mechanism comprises a housing-side locking arm that extends substantially along and underneath a pivoting track of the lever from a side of the initial position to a side of the final position, and a lever-side locking arm that is provided on the lever and that extends in a direction opposite from a direction of extension of the housing-side locking arm, and the lever-side locking arm has a lock release on an upper side of a free end thereof, and also has a locking part that locks with the housing-side locking arm underneath the lock release.

2. The lever type connector according to claim 1, wherein the lever is provided with lever-side locking arm protecting parts that are positioned on both sides of the lever-side locking arm and that protect the lever-side locking arm.

3. The lever type connector according to claim 1, wherein the housing is provided with housing-side locking arm protecting parts that are positioned on both sides of the housing-side locking arm and that protect the housing-side locking arm.

4. The lever type connector according to claim 1, wherein the housing is provided with supporting parts that restrict the downward movement of the lever when the lever is locked in the final position.

5. The lever type connector according to claim 1, wherein the lock release is operated by pushing it in a direction and the lever is pivoted from the final position to the initial position in substantially the same direction.

6. The lever type connector according to claim 1, wherein the lever is substantially U-shaped and spans the housing with the lever side locking arm centrally located on the lever.

7. The lever type connector according to claim 1, wherein the lever-side locking arm has a cantilever structure.

8. The lever type connector according to claim 7, wherein the wherein the lever-side locking arm is bent back from a lower portion of the lever to extend from the side of the final position to the side of the initial position.

9. The lever type connector according to claim 1, wherein the housing-side locking arm has a cantilever structure.

10. The lever type connector according to claim 9, wherein the housing-side locking arm has a locking projection protruding upward from a free end thereof that engages the locking part.

11. The lever type connector according to claim 10, wherein the locking part engages a ramp formed in the locking projection.

* * * * *